US012104469B2

(12) United States Patent
Qu et al.

(10) Patent No.: US 12,104,469 B2
(45) Date of Patent: Oct. 1, 2024

(54) METHOD AND APPARATUS FOR WELL STIMULATION AND PERFORATION

(71) Applicant: Areco Technology Inc., Missouri City, TX (US)

(72) Inventors: Bo Qu, Vaughan (CA); Yalin Jiang, Vaughan (CA)

(73) Assignee: Areco Technology Inc., Missouri City, TX (US)

( * ) Notice: Subject to any disclaimer, the term of this patent is extended or adjusted under 35 U.S.C. 154(b) by 77 days.

(21) Appl. No.: 18/047,635

(22) Filed: Oct. 18, 2022

(65) Prior Publication Data

US 2024/0125213 A1 Apr. 18, 2024

(51) Int. Cl.
*E21B 43/117* (2006.01)
*E21B 43/1185* (2006.01)

(52) U.S. Cl.
CPC ..... *E21B 43/117* (2013.01); *E21B 43/1185* (2013.01)

(58) Field of Classification Search
CPC .. E21B 43/117; E21B 43/1185; E21B 43/263; E21B 43/116; F42B 1/02; F42B 1/032
See application file for complete search history.

(56) References Cited

U.S. PATENT DOCUMENTS 2,843,041 A * 7/1958 Stewart ..... E21B 43/116 175/3.5
3,209,650 A * 10/1965 Andrew ..... F42C 9/10 175/3.5
3,376,375 A * 4/1968 Porter ..... E21B 43/116 175/4.58
9,238,956 B2 * 1/2016 Martinez ..... E21B 43/117
9,617,194 B2 * 4/2017 Glenn ..... F42B 1/036
9,835,014 B2 * 12/2017 Dai ..... F42B 3/08
2005/0056459 A1 3/2005 Haney et al.
2011/0000669 A1 * 1/2011 Barlow ..... E21B 43/12 166/63
2011/0056362 A1 3/2011 Yang et al.
2013/0056212 A1 * 3/2013 Sampson ..... F42B 12/20 166/308.1
2014/0291022 A1 * 10/2014 Yang ..... E21B 43/117 175/2
2015/0362297 A1 * 12/2015 Yang ..... E21B 43/117 102/307
2017/0016297 A1 * 1/2017 Grattan ..... E21B 29/02
(Continued)

FOREIGN PATENT DOCUMENTS

CN 107130946 A 9/2017

*Primary Examiner* — Daniel P Stephenson
(74) *Attorney, Agent, or Firm* — NKL Law; Allen Xue

(57) ABSTRACT

This disclosure provides methods and apparatus for stimulating a well by using structural reactive material while perforating a well casing and well formation in a well at the same time. A structural reactive material member may be attached to a shaped charge to form a hybrid charge. A detonation signal may be transmitted to the one or more hybrid charges to detonate a main explosive in the shaped charges to generate a jet to perforate the well casing and the well formation, break apart the structural reactive material into reactive material particles, and propel the reactive material particles into the well formation for deflagration in the well formation to stimulate the well.

12 Claims, 11 Drawing Sheets

(56) References Cited

U.S. PATENT DOCUMENTS

| | | | | |
|---|---|---|---|---|
| 2020/0270973 | A1* | 8/2020 | Baumann | E21B 43/117 |
| 2020/0392821 | A1* | 12/2020 | Eitschberger | E21B 43/117 |
| 2022/0010660 | A1* | 1/2022 | Dyess | E21B 17/028 |
| 2022/0205343 | A1* | 6/2022 | Fripp | E21B 43/117 |
| 2023/0043064 | A1* | 2/2023 | Loehken | F42B 1/032 |
| 2024/0125213 | A1* | 4/2024 | Qu | E21B 43/1185 |

* cited by examiner

METHOD AND APPARATUS FOR WELL STIMULATION AND PERFORATION

TECHNICAL FIELD

The present disclosure generally relates to oil and gas field services, and more particularly to methods, apparatuses, and systems for well stimulation and perforation.

BACKGROUND

In the oil and gas production operations, especially in tight oil and gas fields, it is often necessary to stimulate new wells and re-stimulate old wells to unblock the production zone. The oil and gas industry currently uses three main stimulation methods, namely acid injection (acid washing), hydraulic fracturing, and explosives. Some also use gas inject for enhanced oil and gas recovery.

With respect to acid injection (acid washing) methods, liquid acidic materials are injected into a well to dissolve some substances to make the formation easy to fracture. These methods are inefficient and risk creating an environmental hazard. In addition, not all downhole rock formations are suitable for acid washing. For example, acid washing usually has a limited effect on non-conventional tight oil and gas wells. However, this method sometimes is used before large-scale hydraulic fracturing. This large-scale hydraulic fracturing is costly, because there is an enormous investment in equipment, materials and labor, and the large-scale hydraulic fracturing is a complex operational process.

Using explosives for well stimulation occurs after the well has been perforated. In this application, well perforation refers to the operation to creating pathway for oil and gas into the borehole after the borehole reaches the pay zone and a casing is installed between the borehole and the formation to protect the borehole. The casing is reinforced by injecting cement between the casing and the formation. For well perforation, shaped charges are lowered in the borehole to the pay zone and fired to form high pressure jets that create a plurality of channels (i.e., perforation tunnels) through the casing, the cement layer, into the formation. Oil and gas in the formation may flow to the borehole through the perforation tunnels. On the other hand, the well formation around the perforation tunnels can be crushed and compacted as a result, forming a crush zone having a lower permeability, impeding the flow of oil and gas. Well stimulation in the application refers to further increase the permeability of the formation around the perforation tunnels.

One way to stimulate the well is to lower deflagration charges into the well after the completion of the perforating operation, and then ignite the deflagration charges. After the ignition of the deflagration charges, a part of the explosive energy enters the perforations to further loosen the reservoir formations. This simple and crude method may still be used only in some vertical wells. However, the effect is very limited as only a small portion of the energy passes into the perforation tunnels.

In another example of using explosives for well stimulation, one or more perforating guns are lowered into the borehole to a desired depth. Explosives, such as propellent or other chemical explosive particles, are usually made into different forms (the propellant grains, propellant tablets, propellant disks), or put in containers, and then loaded inside or outside the perforating guns. The perforating gun is a tubular device that also carries shaped charges. A shaped charge has a metal casing with an explosive inside the metal casing. In this example, the one or more shaped charges are detonated to produce perforating jets to penetrate the well casing, and to shoot into reservoir formations to create perforation tunnels. Also, the one or more shaped charges ignite the propellant and other explosive materials loaded inside or outside the perforating guns. The propellent energy from the ignition of the propellant and other explosive materials may go into the perforation holes, to clean or unblock of the plugged holes. This type of approach is generally known as composite perforating. Due to design of the perforation gun itself, the perforation gun size and the space limitations, the overall ability to carry the secondary energy is relatively small and also requires specially designed perforating guns.

Further, the propellent used to provide a source of energy for a secondary burst pressure have no structural strength. In addition, the production, storage, transportation, and operational costs of these propellants and other explosives are high and the safety risks are high.

In another example, U.S. Pat. No. 9,835,014 discloses a perforation assembly having a shaped charge and a container having a fracture explosive pack provided inside of the container. The assembly is designed to reduce the crush zone and increase oil well production. However, if the design of the assembly with the fractured explosive pack is improper, the explosion may reduce the effectiveness of the perforation or even causing failure of the perforation. The effectiveness of such an assembly varies greatly.

Accordingly, there is a need for a new well stimulation technology, which combines with the conventional perforating process, safely and effectively increases the secondary well stimulation energy.

SUMMARY

This disclosure includes embodiments used in the fields of oil and gas services and enhances well perforation of a well to increase the cleanliness and permeability of a well tunnel after the initial perforating of the well to further stimulate the well more safely and effectively with more significant downhole secondary energy.

In one or more embodiments, there is provided a hybrid charge for perforating and stimulating a well. The hybrid charge may include a shaped charge including a shaped charge case, a shaped charge liner within the shaped charge case, a shaped charge cavity formed between the shaped charge case and the shaped charge liner to receive a main explosive, and a detonating hole including a primer charge and configured to communicate with the shaped charge cavity for detonation of the main explosive; and a structural reactive material member affixed to the shaped charge, wherein the reactive material comprises at least one metal and at least one oxygen-free oxidizer.

In one or more embodiments, the reactive material member may have a shape of a cap, a ring, two half rings, or multiple sections of a ring shape.

In one or more embodiments, during operation, the shaped charge may detonate and create a jet that penetrates the formation to form a perforation tunnel, and the reactive material member may enter the perforation tunnel and may release energy to further break the formation surrounding the perforation tunnel.

In one or more embodiments, the least one metal may be selected from the group consisting of aluminum, magnesium, molybdenum, nickel, zinc, and titanium, and at least one oxygen-free oxidizer is one or more fluoropolymers.

In one or more embodiments, the reactive material member may have a strength in a range of 1-20 megapascal pressure (MPa), which is about 145-2900 pounds force per square inch (psi).

In one or more embodiments, the reactive material member may have a mass in a range of 3 to 100 grams.

In one or more embodiments, there is provided hybrid downhole stimulation tool for perforating a well formation and stimulating a well. The hybrid downhole stimulation tool may include one or more hybrid charges. a barrel having a tubular shape configured to be lowered into a borehole of the well having a well casing separating the borehole from the well formation; one or more hybrid charges may be loaded into the barrel; a detonating cord, which may be coupled to the one or more hybrid charges; and a detonator may be configured to receive a triggering instruction from a firing control system, and may be configured to ignite the detonation cord to detonate the one or more hybrid charges.

In one or more embodiments, there is provided hybrid downhole stimulation tool for perforating and stimulating a well formation. The hybrid downhole stimulation tool may include a hybrid charge loading strip including a plurality of fastening members connected together, a plurality of explosive charges, each explosive charge may be affixed to one of the plurality of fastening members, wherein each explosive charge may be a hybrid charge or a shape charge; a detonating cord, which may be coupled to the plurality of fastening members; and a detonator may be configured to receive a triggering instruction from a firing control system, and may be configured to ignite the detonation cord to ignite the plurality of explosive charges.

In one or more embodiments, each fastening member may be made of or may contain the reactive material.

In one or more embodiments, there is a method for stimulating a well, which may include lowering one or more hybrid charges oriented in one or more directions into a well including a well formation, each hybrid charge including a shaped charge comprising a main explosive and a reactive material attached to a shaped charge, and igniting the one or more hybrid charges to generate one or more jets to perforate the well formation to form one or more perforation tunnels in the well formation, to crush the structural reactive material member in to particles and to propel the reactive material particles of the one or more reactive material members of the one or more hybrid charges into the perforated well formation, and to excite the reactive material to execute a deflagration reaction in the one or more perforation tunnels to stimulate the well.

In one or more embodiments, the reactive material member may include at least one metal selected from the group consisting of aluminum, magnesium, molybdenum, nickel, zinc, and titanium: and at least one oxygen-free oxidizer, which includes one or more fluoropolymers.

In one or more embodiments, each reactive material member may have a strength in a range of 1-20 megapascal pressure (Mpa), which is about 145-2900 pounds force per square inch (psi).

In one or more embodiments, there is a method for stimulating a well, which may include lowering a tube including a laser cutting tool positioned with the tube, wherein one or more reactive material members is attached to an outside surface of the tube; and activating the laser cutting tool to generate one or more laser beams to: strike one or more material members to break the one or more reactive material members into reactive material particles and excite the reactive material particles, perforate the well casing and the well formation to form one or more perforation tunnels in the well formation, and propel the excited reactive material particles into the one or more perforation tunnels to execute a sustained deflagration reaction of the excited reactive material particles to stimulate the well.

In one or more embodiments, the reactive material member may include at least one metal selected from the group consisting of aluminum, magnesium, molybdenum, nickel, zinc, and titanium: and at least one oxygen-free oxidizer, which includes one or more fluoropolymers.

In one or more embodiments, each reactive material member may have a strength in a range of 1-20 megapascal pressure (Mpa), which is about 145-2900 pounds force per square inch (psi).

In one or more embodiments, there is provided hybrid downhole stimulation tool for perforating a well formation and to stimulate a well at the same time. The hybrid down hole stimulation tool may include a barrel having a tubular shape configured to be lowered into a borehole of the well having a well casing separating the borehole from the well formation; one or more hybrid charges, which include a structural reactive material member attached to a shaped charge, and which are loaded into the barrel; a detonating cord, which is coupled to the one or more hybrid charges; and a detonator configured to receive a triggering instruction from a firing control system, and configured to ignite the detonation cord. The shaped charge may include a shaped charge case, shaped charge liner within the shaped charge case, a shaped charge cavity formed between the shaped charge case and the shaped charge liner to receive a main explosive, and a detonating hole to receive a primer charge, which interfaces with the detonating cord. The detonating cord may be ignited by the detonator to ignite the primer charge in the one or more hybrid charges. The primer charge in the one or more hybrid charges may detonate the main explosive of the shaped charge, and the explosion squeezes the liner to generate a jet, which perforates the well casing and the well formation. The shock wave and high heat along with the jet will shatter the reactive material structural members into particles. The particles will be propelled to follow the jet going into the perforated tunnels. Especially the rear end of the jet will collect more particles into the perforated tunnels. The excited reactive material particles execute a sustained deflagration reaction, and release kinetic and thermal chemical energy to stimulate the formation.

In one or more embodiments, the reactive material member may have a shape of a cap, a ring, two half rings, or multiple sections of a ring shape.

In one or more embodiments, the reactive material member may include at least one metal selected from the group consisting of aluminum, magnesium, molybdenum, nickel, zinc, and titanium: and at least one oxygen-free oxidizer, which includes one or more fluoropolymer.

In one or more embodiments, the reactive material member has a mass in a range of 3 to 50 grams.

In one or more embodiments, the reactive material member has a strength in a range of 1 to 20 megapascal pressure (MPa), which is in a range of about 145 to 2900 pounds force per square inch (psi).

In one or more embodiments, the reactive material member is attached to an open face of the shaped charge or to a side of the shaped charge.

In one or more embodiments, there is provided a hybrid downhole stimulation tool for perforating a well formation to stimulate a well. The hybrid downhole stimulation tool may include one or more hybrid charges, which include a reactive material member attached to a shaped charge, wherein each hybrid charge has a sealed body; a hybrid charge loading strip including fastening members, wherein each fastening member is configured to receive one of one or more hybrid charges, and wherein the hybrid charge loading strip is configured to be lowered into a borehole of the well having a well casing separating the borehole from the well formation; a detonating cord, which is coupled to the one or more hybrid charges; and a detonator configured to receive a triggering instruction from a firing control system, and configured to ignite the detonation cord. The shaped charge may include a shaped charge case, shaped charge liner within the shaped charge case, a shaped charge cavity formed between the shaped charge case and the shaped charge liner to receive a main explosive, and a detonating hole to receive a primer charge, which interfaces with the detonating cord. The detonating cord may be ignited by the detonator to ignite the primer charge in the one or more hybrid charges. The primer charge in the one or more hybrid charges may detonate the main explosive, and the explosion collapses the liner to generate a jet. which perforates the well casing and the well formation. The shock wave and high heat along with the jet will shatter the reactive material structural members into particles. The particles will be propelled to follow the jet going into the perforated tunnels. Especially the rear end of the jet will collect more particles into the perforated tunnels. The excited reactive material particles execute a sustained deflagration reaction, and release kinetic and thermal chemical energy to stimulate the formation.

In one or more embodiments, the reactive material member may have a shape of a cap, a ring, two half rings, or multiple sections of a ring shape.

In one or more embodiments, the reactive material member may include at least one metal selected from the group consisting of aluminum, magnesium, molybdenum, nickel, zinc, and titanium: and at least one oxygen-free oxidizer, which includes one or more fluoropolymer.

In one or more embodiments, the reactive material member has a mass in a range of 3 to 100 grams.

In one or more embodiments, the reactive material member has a strength in a range of 1 to 20 megapascal pressure (MPa), which is in a range of about 145 to 2900 pounds force per square inch (psi).

In one or more embodiments, the reactive material member is attached to an open face of the shaped charge or to a side of the shaped charge.

In one or more embodiments, there is provided one or more embodiments, the hybrid downhole stimulation tool for perforating a well formation and stimulating a well. The hybrid downhole stimulation tool may include one or more hybrid charges, which include a reactive material attached to a capsuled shaped charge (or a capsule charge) one or more charge holders consisting of the reactive material, wherein each charge holder is attachable to one or two of the one or more charge holders, so that attachment of two or more charge holders forms a reactive material carrier, and wherein the reactive material carrier is configured to be lowered into a borehole of the well having a well casing separating the borehole from the well formation; a detonating cord, which is coupled to the one or more hybrid charges; and a detonator configured to receive a triggering instruction from a firing control system, and configured to ignite the detonation cord. The capsuled shaped charge may include a shaped charge case, shaped charge liner within the shaped charge case, a shaped charge cavity formed between the shaped charge case and the shaped charge liner to receive a main explosive, and a detonating hole to receive a primer charge, which interfaces with the detonating cord. The detonating cord is ignited by the detonator to ignite the primer charge in the one or more hybrid charges. The primer charge in the one or more hybrid charges detonates the main explosive, and the explosion collapses the liner to generate a jet which perforates the well casing and the well formation. The shock wave and high heat along with the jet will shatter the reactive material structural members into particles. The particles will be propelled to follow the jet going into the perforated tunnels. Especially the rear end of the jet will collect more particles into the perforated tunnels. The excited reactive material particles execute a sustained deflagration reaction, and release kinetic and thermal chemical energy to stimulate the formation.

In one or more embodiments, the reactive material member may include at least one metal selected from the group consisting of aluminum, magnesium, molybdenum, nickel, zinc, and titanium: and at least one oxygen-free oxidizer, which includes one or more fluoropolymer.

In one or more embodiments, the reactive material of each carrier holder has a mass in a range of 5 to 200 grams.

In one or more embodiments, the, wherein the reactive material has a strength in a range of 1 to 20 megapascal pressure (MPa), which is in a range of about 145 to 2900 pounds force per square inch (psi).

In one or more embodiments, there is provided a hybrid downhole stimulation tool for perforating a well formation and stimulating a well. The hybrid downhole stimulation too may include a tube fixed with a laser cutting tool and configured to be lowered into a borehole of the well, wherein a well casing separates the borehole from the well formation of the well; one or more reactive material members are attached to an outside surface of the tube; wherein the laser cutting tool generates one or more laser beams to: perforate the well casing and the well formation to form one or more perforation tunnels in the well formation, strike one or more reactive material members to break the one or more reactive material members into reactive material particles and excite the reactive material particles, and propel the excited reactive material particles into the one or more perforation tunnels to execute a sustained deflagration reaction of the excited reactive material particles, and release kinetic and thermal chemical energy to stimulate the well formation.

In one or more embodiments, the reactive material member may include at least one metal selected from the group consisting of aluminum, magnesium, molybdenum, nickel, zinc, and titanium: and at least one oxygen-free oxidizer, which includes one or more fluoropolymer.

BRIEF DESCRIPTION OF THE DRAWINGS

The teachings of the present invention can be readily understood by considering the following detailed description in conjunction with the accompanying drawings.

DETAILED DESCRIPTION

Figure 1:
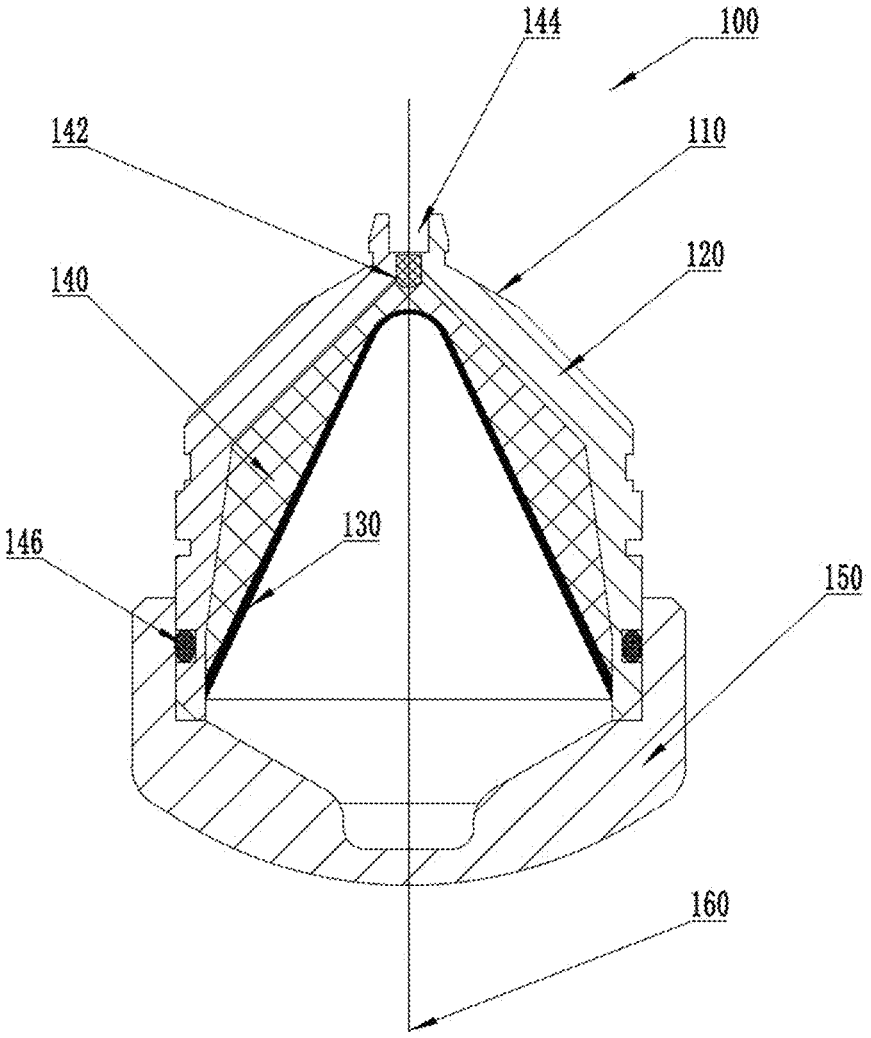
FIG. 1 is a cross sectional view of a hybrid charge according to an embodiment.

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the disclosure.

The disclosure includes one or more embodiments related to downhole stimulation tools for oil and gas wells that can provide more operational effectiveness with cost saving as well as safety advantages compared to existing explosive stimulation and acid stimulation methods and reduce the negative environmental impact. One or more embodiments may even become a hydraulic fracturing pre-process to enhance the effectiveness of fracturing. Examples of the downhole stimulation tools include perforation guns, perforation gun strings, and energy generation devices, which generate laser beams, plasma beams, and the like.

These downhole stimulation tools for oil and gas well stimulation include at least one or more reactive material members. These reactive material members have (1) sufficient mechanical strength, (2) very stable material properties, and (3) high energy density. The reactive material members are safer and convenient for preparation, transportation, and installation. The reactive material members can be made from two or more non-explosive solid materials that remain inert under normal conditions and only react at very high impact, very high temperature, and very high-pressure conditions. The reactive material member is excitable in an oil and gas well, with perforating charges at downhole, or with high-energy laser at downhole. For example, the downhole stimulation tools can include one or more perforating charges and the charges can be detonated at a downhole condition, which produces a high-pressure jet. This high-pressure jet may be referred to as a perforating jet, a perforating jet stream, a jet stream, or a jet. Without wishing to be bound by the theory, it is expected that this jet produces high pressure shockwaves and heat to break apart the reactive material member into reactive material particles. This jet also excites the reactive material particles to react to induce deflagration chemical reactions and to release heat energy and kinetic energy in the well formation, primarily in the perforation tunnels. In another example, another downhole stimulation tool is equipped to generate laser beams, plasma beams, or the like that can produce high impact and rapid heating conditions to excite one or more reactive material members, so as to release heat energy and kinetic energy and induce deflagration chemical reactions in the formation.

FIG. 1 is a cross sectional view of a hybrid charge 100 according to an embodiment. The hybrid charge 100 includes a shaped charge 110 having a shaped charge case 120, a shaped charge liner 130 within the shaped charge case 120, and a shaped charge cavity 140 formed between the shaped charge case 120 and the shaped charge liner 130 to receive an explosive. The shaped charge 110 may further include a detonating hole 142 configured to accommodate a primer charge (primer igniter) and configured to communicate with the shaped charge cavity 130 for detonation of the explosive. The shaped charge 110 may further include a detonation cord groove 144 configured to receive a detonation cord which communicates with the primer charge in the detonating hole 142 for detonation of the explosive in the shaped charge cavity 140. A triggering instruction (e.g., electrical detonation signal) from a firing control system from the surface above a borehole of a well may ignite the detonation cord, which communicates with the primer charge for detonation. The shaped charge liner 130 may be a metal. The shaped charge 110 may have different shapes. The hybrid charge 100 may also have an O-ring 146.

The hybrid charge 100 further includes a reactive material member 150 attached to the shaped charge 110. The reactive material member 150 may be attached to the frontal face (e.g., facing the formation when installed) of the shaped charge 110 as shown in FIG. 1. The attachment of reactive member 150 may include mounting, connecting, or coupling the reactive member 150 to the shaped charge 110, e.g., by compressing the O-ring 146. The attachment of the reactive member 150 may include integrating the reactive member 150 with the shaped charge 110. In the embodiment of FIG. 1, the reactive member 150 effectively covers the frontal face of the shaped charge case 120 and sealed the inner chamber of the shaped charge 110 from elements (e.g., fluids) in the borehole. In some other embodiments, the shaped charge 110 has its own cover to seal its inner chamber from elements in the borehole while the reactive material member 150 is affixed to the cover or other suitable part of the shaped charge 110.

The reactive material member 150 may be in the form of a cap, a ring, two half rings, multiple sections of a ring, or other structure. The cap shape may have an uneven thickness with a center of the cap being the thinner part. The reactive material member 150 may have different shapes. The reactive material member 150 includes at least one metal and at least one oxygen-free oxidizer. The reactive material member 150 is inert under normal conditions.

When the explosive in the shaped charge cavity 140 is detonated, the power and heat released from explosive collapses and melts the shaped charge liner 130 and forms the jet, which may also be referred to as a perforating jet, a perforating jet stream, a jet stream. The powerful shockwave and heat released from the detonation of the explosive along with the jet breaks the reactive material member 150 into reactive material particles, which excites the reactive material particles. Detonation is a high velocity explosion (power shock wave) for high explosives in a shaped charge such as shaped charge 110. Detonation of the explosive initiates deflagration of the reactive material member such as reactive material member 150. Detonation is a high velocity (supersonic) explosion and deflagration is a low velocity reaction (subsonic).

A reference line 160 denotes the general direction of a jet generated by the detonation of the explosive in the shaped charge cavity 140 in FIG. 1. A section of the reactive material member 150 may be thinner at or about the reference line 160, so that the reactive material member 150 minimizes interference with the direction of the jet. The jet penetrates the casing of the well (well casing) and shoots into the surrounding formation (well formation) to form perforation tunnels in the formation (well formation). The jet carries the excited reactive material particles into the well formation. Accordingly, the well casing and the well formation are perforated. The jet propels the excited reactive material particles to the perforated well formation. The excited reactive material particles produce a deflagration reaction in the perforated well formation to stimulate the well.

The reactive material member 150 may be made from two or more non-explosive solid materials that remain inert under normal conditions and do not react with each other. However, when these two or more non-explosive materials are subjected to sufficiently strong mechanical, electrical, laser stimuli, plasma stimuli, and the like producing sufficient heat, these two or more non-explosive materials undergo rapid combustion or bursting due to deflagration chemical reactions, which releases large amounts of chemical energy in addition to kinetic energy.

As discussed above, the reactive material member 150 includes at least one metal and at least one oxygen-free oxidizer. The reactive material member 150 may include at least one metal such as aluminum, magnesium, molybdenum, nickel, zinc, and titanium, and may include at least one oxygen-free oxidizer such as one or more fluoropolymers. The deflagration chemical reaction will be between the at least one metal and at least one oxygen-free oxidizer.

The one or more fluoropolymers of reactive material member 150 may include fluorothermoplastics and fluoroelastomers (including so-called fluoro-rubbers) such as polytetrafluoroethylene, tetrafluoroethylene/hexafluoropropylene/vinylidene fluoride terpolymers, and vinylidene fluoride and hexafluoropropylene di-polymers (copolymers) among others. These and other suitable matrix fluoropolymers are available from Dyneon LLC of Oakdale, Minn. (Dyneon™ Fluorothermoplastic THVx240A and THVx246; Fluorel™ Fluoroelastomer FC 2174 (a curable copolymer of vinylidene fluoride and hexafluoro propylene), and Dyneon™ THY Fluorothermoplastic 200P (terpolymer of TFE/VDF/HFP); DuPont (7 series fluoropolymer resins of which resins 7A and 7C are illustrative)). Other fluoropolymer resins available from DuPont include Teflon® NXT75 fluoropolymer resin (modified PTFE granular molding resin) and Viton® brand fluoroelastomers such as Viton® B and Vitron® E-60C. Exemplary, vulcanizable (curable) extrudable fluoropolymers are available from Zeus Int'l (Orangeburg, S.C.) and these include the "FEP" resin.

The reactive material member 150 is made of extremely low-sensitivity reactive material, and is very safe in the ground production process, transportation, disposal, and installation process. The reactive material member 150 cannot be excited in an open environment with an open flame.

The reactive material member 150 may have a strength in a range of 1-20 megapascal pressure (MPa), which is about 145-2900 pounds per square inch (psi). The reactive material member 150 may have a deflagration velocity in a range of 1500-2000 meters per second upon excitement or detonation. The reactive material member may have a mass in the range of 3-50 grams.

As discussed above, an explosive is placed in a shaped charge cavity 140 formed between the shaped charge case 120 and the shaped charge liner 130. This explosive may be a high explosive such as 1,3,5-trinitroperhydro-1,3,5-triazine (RDX) and octahydro-1,3,5,7-tetranitro-1,3,5,7-tetrazocine (HMX). The explosive may have a detonation velocity in the range of 6000 to 8000 meters per second upon excitement or detonation.

Accordingly, a detonation of the explosive in the shaped charge cavity 140 is a type of high explosive reaction that produces an extremely high-pressure jet to perforate the well casing and the formation (well formation) to create a tunnel (pathway) for oil and gas to flow into the well (permeate into the well). This tunnel may be referred to as a perforation tunnel. Because the front-end detonation velocity of the jet is about 6,000-8,000 meters/second and the temperature of the jet is between 350° C. and 1,000° C., the detonation velocity and the high temperatures produced by the jet (perforating jet, perforating jet stream or jet stream) are sufficient to break apart the reactive material member 150 and excite the deflagration reaction of the reaction material particles from the reactive material member 150. The reaction material burst reaction speed (deflagration velocity) is only 1500-2000 meters/second, and the reaction temperature is about 350° C. and up. This is much lower than the explosive velocity and temperature of the jet, so the reaction material member 150 can be broken into participles, delivered to the perforated well formation, and fully excited by the strong shock waves and the heat to produce a sustained deflagration reaction in the perforated well formation. Accordingly, the reaction rate of the reactive material member 150 is much slower than the high explosive in the cavity 140. In addition, the energy density of the reactive material member 150 may be 2 to 3 times higher than the high explosive in the cavity 140. The slower reaction rate and the high energy density of the reactive material member 150 effectively and efficiently stimulate the well. More specifically, this high-energy deflagration chemical reaction releases mechanical energy and high-density chemical energy to the oil and gas well formation through perforation tunnels, greatly enhancing the perforation tunnels and increasing the energy level to stimulate the downhole formation and re-fracturing the blocked area so that oil and gas flows into the well (permeates into the well).

Embodiments shown in FIGS. 2 through 5 show apparatuses and methods for delivering one or more hybrid charges 100 into a well to perforate the well casing and well formation while furtherly to stimulate the perforated well formation.

Figure 2:
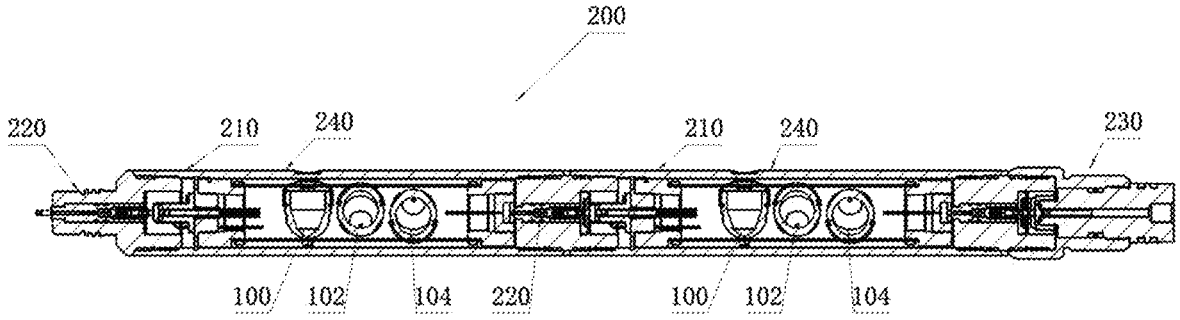
FIG. 2 is a view of a hybrid downhole stimulating tool according to an embodiment.

FIG. 2 is view of a hybrid downhole stimulating tool (hybrid downhole stimulating assembly) for well perforation and stimulation according to an embodiment. In this exemplary embodiment, FIG. 2 shows a perforation gun string 200, which is an example of a hybrid downhole stimulating tool. The perforation gun string 200 carries hybrid charges and may be lowered into a well, which has a casing installed between a borehole and a formation, which is desired for oil and gas production. However, the perforation gun string 200 is only one example. For example, the hybrid downhole stimulating tool may be a steel barrel or other metallic barrel lowered into a borehole of a well for delivering hybrid charges into the borehole of the well. As discussed above, the casing separates the borehole and the formation from each other. The casing may comprise a metal such as carbon steel or stainless steel. Alternatively, the casing may be made from engineering plastics. The casing may be referred to as a well casing, and the formation may be referred to as a well formation.

The perforation gun sting 200 may include one or more perforation gun assemblies 210 such as the two perforation gun assemblies 210 coupled to each other as shown in FIG. 2. A perforation gun assembly 210 and a perforation gun string 200 are examples of a hybrid downhole stimulating tool (downhole stimulating assembly). Each of the perforation gun assemblies 210 may include a firing head 220. A triggering instruction (e.g., electrical detonation signal) from a firing control system from the surface above a borehole of a well may be transmitted to the firing head 220, which may be used in triggering detonation of one or more hybrid charges.

One of the perforation gun assemblies 210 may be coupled to a connection sub 230 to connect to other downhole assemblies or tools. Each of the perforation gun 210 assemblies may include a perforation gun barrel 240. A perforation gun barrel 240 may have a tubular shape for carrying one or more hybrid charges such as hybrid charges 100, 102, and 104. The perforation gun barrel 240 may also be referred to as a hybrid charge loading tube. The one or more hybrid charges include a reactive material member 150 attached to a shaped charge. The one or more hybrid charges may have the same shape or different shapes. As shown in FIG. 2, hybrid charges 100, 102, and 104 have different shapes. However, hybrid charges 102 and 104 also include a reactive material member attached to the open face of a shaped charge as with hybrid charge 100 or may be attached to a side of the shaped charge. Although FIG. 2 shows an embodiment with hybrid charges 100, 102, and 104 inside a perforation gun barrel 240, one or more hybrid charges may be attached to the outside of the perforation gun barrel 240. The perforation gun barrel 240 may have one or more holes such as scalloped holes. The one or more hybrid charges may be oriented so that one or more jets generated by the detonation of the explosive in one or more shaped charges are directed toward the one or more holes in the gun barrel 240.

Although FIG. 2 shows two perforation gun assemblies 210 connected together, a perforation gun string may have one or more perforation gun assemblies 210. According to FIG. 2, hybrid charges 100, 102, and 104 are arranged in different orientations so that they point to different directions when lowered into the borehole. The one or more perforation gun assemblies 210 may have one or more hybrid charges, and these one or more hybrid charges may have the same shape, different shapes, or a combination thereof as required by the particular circumstances in the borehole.

The firing head 220 is a mechanical or electrical device used to detonate an explosive stored in a shaped charge cavity 140 of a hybrid charge 100. One or more hybrid charges 100 may be conveyed by one or more perforation gun barrels 240. A firing head 220 may be a mechanical firing head having a percussion detonator struck by a firing pin or an electronic firing head (which may be powered by a battery, or wireline control from surface) to initiate an electric detonator.

The hybrid charges 100, 102, and 104 may have different shapes as shown in FIG. 2. The firing head 200 may trigger the detonation of a high explosive or high explosives in shaped charge cavity 140 of hybrid charges 100, 102, and 104 in the perforation gun barrels 240. The perforation gun barrels 240 may have a hole opposite one or more of the shaped charges. For example, a detonation of a high explosive or high explosives in shaped charge cavity 140 of hybrid charge 100 generates a jet (a perforating jet, a perforating jet stream or a jet stream) along reference line 160 in FIG. 1 and shoots the jet toward the hole opposite the hybrid charge 100, toward the well casing, and the well formation to provide perforation tunnels in the well formation.

Figure 3:
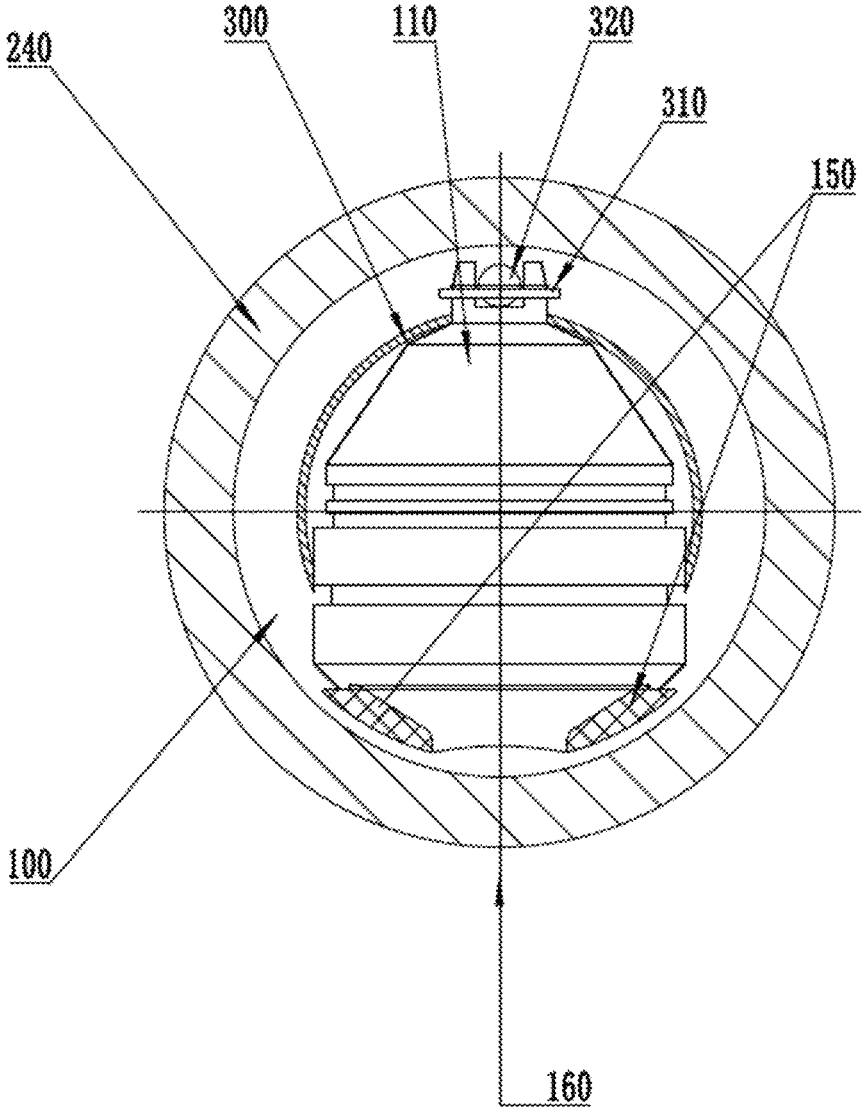
FIG. 3 is a cross sectional view of a hybrid downhole stimulating tool according to an embodiment.

FIG. 3 is a cross sectional view of a of a hybrid downhole stimulating tool (hybrid downhole stimulating assembly) for well perforation and stimulation according to an embodiment. As discussed above, the perforation gun string 200 is an example of a downhole stimulating tool. The perforation gun string 200 may include one or more perforation gun assemblies. A perforation gun assembly 210 is an example of a hybrid downhole stimulating tool (hybrid downhole stimulating assembly). A hybrid charge 100 including the shaped charge 110 and the reactive material member 150 is shown in FIG. 3. In FIG. 3, a charge carrier 300, which may be a charge tube, carries the hybrid charge 100. A circlip 310 may fasten a detonator cord 320 positioned in detonation cord groove 144 to hold the detonation cord 320 in position.

As discussed above with reference to FIG. 2, a firing head 220 may trigger the detonation of a high explosive or high explosives in shaped charge cavity 140 of hybrid charge 100 in the perforation gun barrels 240. In one example, with reference to FIGS. 2 and 3, the firing head 200 may be connected to a detonation cord 320 to trigger the detonation of a high explosive or high explosive in the shape charge cavity 140 of hybrid charge 100 in the perforation gun barrels 240. For example, when the high explosive or high explosive in the shape charge cavity 140 of hybrid charge 100 is detonated, the one or more explosives (main explosive), which is usually a RDX or HMX type, in the shaped charge cavity 140, will squeeze the shaped charge liner 130 of the hybrid charge 100, which will form a high pressure jet to be able to penetrate the perforation gun barrel 240 at the hole, the well casing, and the well formation including creating perforation tunnels in the well formation. Alternatively, when the main explosive is detonated, the high-pressure jet penetrates the gun barrel 240 forming a continuous channel through the gun barrel 240, the well casing and the well formation, creating a perforation tunnel in the well formation. The extremely high-pressure jet is also referred to as a perforating jet, a perforating jet stream, a jet stream, or a jet, which is directed along reference line 160 in FIG. 1.

The shock wave of the jet breaks the reactive material member 150 into reactive material particles, the reactive material particles are pushed and/or pulled by the jet into the perforated tunnels. Without wishing to be bound by the theory, it is expected that more of the reactive material particles follow the tail of the jet in its wake into the perforated tunnels in the perforated formation. The reactive material particles are fully excited by the high pressure shock waves and heat, and produce a sustained deflagration reaction in the perforated tunnels in the perforated formation (perforated well formation). The sustained deflagration stimulates the well so that oil and gas enter the well for removal from the well.

The size and shape of the reactive material members 150 may be designed and made according to the size of the shaped charges and dimensions of the perforation gun barrels 240. The material mass of the reactive material members 150 may be in the range of 3-50 grams in the condition with a perforation gun barrel 240 shown in the FIG. 1. In alternative embodiments, the reactive material members 150 may be a whole structure, or several reactive material members at different sizes and shapes and can be installed separately. The perforation gun string 200 including one or more perforation gun assemblies 210 may be retrieved from the well bore and provided to the surface after the shooting of the jet to penetrate the well formation and delivery of the reactive material particles into the perforated tunnels of the perforated well formation. The perforation gun string 200 including one or more perforation gun assemblies 210 may be a sealed system, so that the hybrid charges are not exposed to the well while the perforation gun string 200 is lowered into the borehole of the well.

Figure 4:
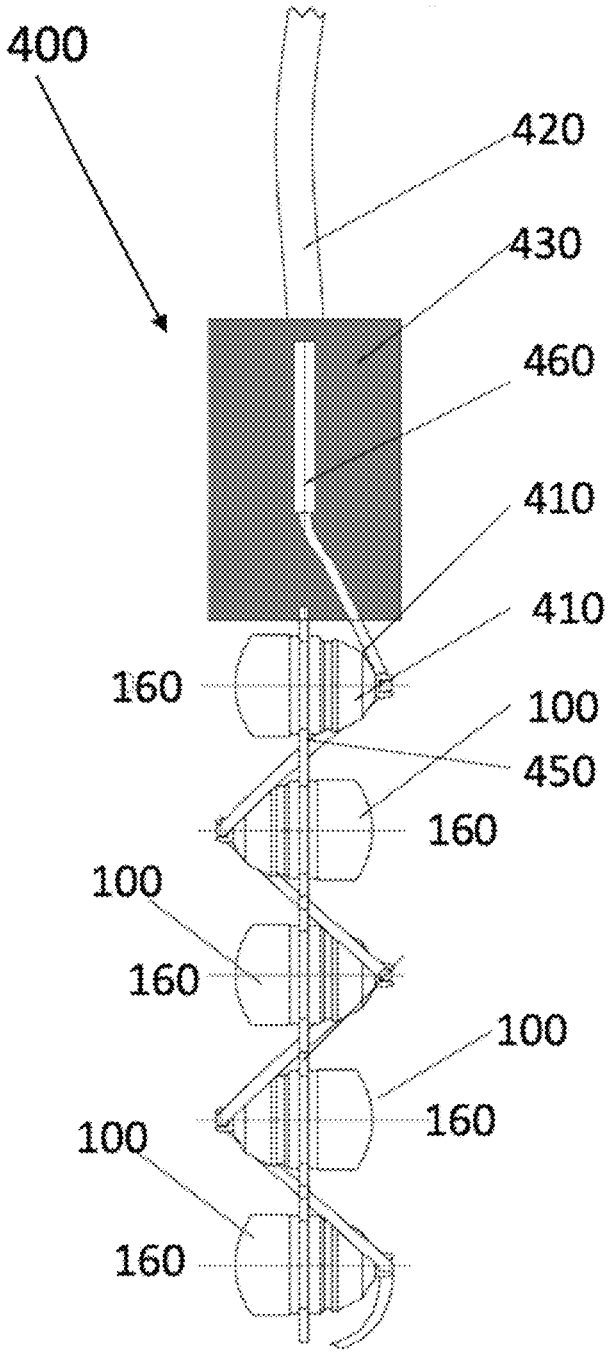
FIG. 4 is a view of a hybrid downhole stimulating tool according to an embodiment.

FIG. 4 is a view of a hybrid downhole stimulating tool (downhole stimulating assembly) for well perforation and stimulation according to an embodiment. FIG. 4 shows another exemplary embodiment of a hybrid downhole stimulating tool, which includes a perforating gun string 400 without a gun barrel, which is configured to carry hybrid charges (such as hybrid charge 100) including a reactive material member 150 and deliver the hybrid charges into a bore hole. As discussed above, a well casing is positioned between the borehole and the formation (well formation). In this exemplary embodiment, hybrid charges such as hybrid charges 100 may be exposed to well fluids and pressures in the borehole. However, the selection of the size of hybrid charges is more flexible so that the hybrid charges may be delivered through small or restricted areas in the well bore. The single mass of the reactive material member can have a range of 3-100 grams. This tool also can be used for through-tubing perforation and stimulation after a production tubing is installed.

The perforating gun string 400 in FIG. 4 may include a detonation cord 410, a wireline cable 420, a connection sub 430, a carrier strip 450, and a detonator 460. The carrier strip 450 may also be referred to as a hybrid carrier strip, a rack, or a hybrid charge loading strip. The carrier strip 450 may be steel or another metal. The carrier strip 450 may receive hybrid charges 100 as shown in FIG. 4. Alternatively, the carrier strip 450 may accommodate hybrid charges of different shapes and sizes than hybrid charges 100 such as hybrid charges 102 or hybrid charges 104. All shapes and sizes of the hybrid charges accommodated by the carrier strip 450 may be the same. Alternatively, different shapes and sizes of hybrid charges may be accommodated by the carrier strip 450 at the same time. In addition, the carrier strip 450 may accommodate one or more hybrid charges may have the same shape and size as well as one or more hybrid charges having different shapes and sizes. The carrier strip 450 may include one or more fastening members. A fastening member is configured to receive a hybrid charge 100. For example, the hybrid charge 100 may snap into the fastening member.

The wireline cable 420 may receive a triggering instruction (e.g., electrical detonation signal) from a firing control system from the surface above the borehole. The connection sub 430 includes the detonator 460, which may forward the electrical detonation signal to the detonator cord 410. The detonation cord 410 may be positioned in a detonation cord groove such as detonation cord groove 144 of each hybrid charge such as hybrid charge 100, so that the igniting of the detonation cord 410 ignites primer charge in the detonating hole 142 to initiate detonation of the main explosive in the shaped charge cavity 140. In addition, carrier strip 450 orients the hybrid charges 100 in two different directions. In alternative embodiments, the carrier strip 450 can orient any hybrid charge 100 in any direction and at any angle, so that a jet is generated upon detonation of the main explosive and shoots in a particular direction such as the direction shown by reference line 160.

As discussed above, when the high explosive or high explosive in the shape charge cavity 140 of hybrid charge 100 is detonated, the one or more explosives (main explosive), which is usually a RDX or HMX type, in the shaped charge cavity 140, will squeeze the shaped charge liner 130 of the hybrid charge 100, which will form an extremely high pressure jet to be able to penetrate the well casing and the well formation including creating perforation tunnels in the well formation. The high-pressure jet is also referred to as a perforating jet, a perforating jet stream, a jet stream, or a jet, which is directed along reference line 160 in FIG. 4, which is directed toward the well casing and the well formation to provide perforation tunnels in the well formation. In addition, the power and heat released from the detonation of the main explosive also breaks the reactive material member 150 into reactive material particles, which excites the reactive material particles. The reactive material particles will be forced to follow the direction of the jet going into the perforated tunnels. Especially, the rear end of the jet (tail of the jet or jet tail) will shoot more particles into the perforated tunnels in the perforated formation. The reactive material particles are fully excited by the shock waves and heat, and produce a sustained deflagration reaction in the perforated tunnels in the perforated formation (perforated well formation). The sustained deflagration stimulates the well so that oil and gas enter the well for removal from the well. Because the sustained deflagration in the formation occurs after the well casing has been penetrated and the well formation has been penetrated, this effectively increases the permeability of the well formation. The sustained deflagration stimulates the well so that oil and gas enter the well for removal from the well.

FIGS. 5A through 5F illustrate holders configured to receive hybrid charges, as well as the coupling of these charge holders 500, 550, and 570. It is understood that these charge holders 500, 550, and 570 are exemplary embodiments and other configurations of charge holders configured to receive charges such as hybrid charges are contemplated. The exemplary embodiments refer to hybrid charges. However, it is understood that other charges such as shaped charges or other perforation charges may be held by charge holders such as charge holders 500, 550, and 570 in FIGS. 5A through 5F. The charge holders 500, 550, and 570 may be the same shape and size, or the charge holders 500, 550, and 570 may have different shapes and sizes to accommodate hybrid charges of different shapes and sizes. The charge holders 500, 550, and 570 may be angled in any direction. Therefore, the hybrid charges may be angled in any direction. Each charge holder may be configured to be attachable to one or more charge holders 500, 550, and 570 to form a charge holder carrier, and each charge holder 500, 550, and 570 may be configured to be detachable from one or more charge holders 500, 550, and 570. The charge holders 500, 550, and 570 can be made of non-reactive material such as steel or engineering plastics. They can also be made of or contain the reactive material so that, when receiving a shaped charge or other perforation charge, this forms hybrid charges. Alternatively, the reactive material charge holders 500, 550, and 570 can still receive a hybrid charge, thus packing more reactive materials for well stimulation. The mass of the charge holders 500, 550, and 570 may be in a range of 5-200 grams due to less space constraints.

The hybrid downhole stimulating tools (hybrid downhole stimulating assemblies) using the charge holders 500, 550, and 570 in FIGS. 5A through 5F are lowered into a borehole of a well and the charges are detonated to produce high-pressure jets to perforate the well casing and the formation (well formation) to create perforation tunnels for oil and gas to flow into the well (permeate into the well). A triggering instruction (e.g., electrical detonation signal) from a firing control system from the surface above a borehole of a well may be transmitted to one or more hybrid charges for detonation. Because charge holders 500, 550, and 570 may be made of the reactive material, the charge holders 500, 550, and 570 may also be reactive material members, and the power and heat released from the detonation of the main explosive also breaks the reactive material of the charge holders 500, 550, and 570. Accordingly, a perforation gun sting such as perforation gun string 200 or a carrier strip such as carrier strip 450 are not required to deliver the hybrid charges such as hybrid charges 100 into the borehole. Instead, as shown in FIG. 4, the wireline cable 420 may receive an electrical detonation signal from the surface above the borehole. The connection sub 430 includes the detonator 460, which may ignite the detonator cord 410 in response to a triggering instruction from the fire control system. The detonation cord 410 may be positioned in a detonation cord groove such as detonation cord groove 144 of each hybrid charge such as hybrid charge 100, so that the ignited detonator cord 410 ignites the primer charge in the detonating hole 142 to initiate detonation of the main explosive in the shaped charge cavity 140.

As discussed above, the power and heat released from the detonation of the main explosives also breaks the reactive material into reactive material particles in both the hybrid charges and the charge holders 500, 550, and 570, which excites the reactive material particles. The reactive material particles will be forced to follow the direction of the jet going into the perforated tunnels. Especially, the rear end of the jet (tail of the jet or jet tail) may pull in its wake more particles into the perforated tunnels in the perforated formation in a particular direction such as the direction shown by reference line 510 in FIGS. 5A, 5C, and 5E. The reactive material particles are fully excited by the shock waves and heat, and produce a sustained deflagration reaction in the perforated tunnels in the perforated formation (perforated well formation). The sustained deflagration stimulates the well so that oil and gas enter the well for removal from the well. In an alternative embodiment, one or more shaped charges may be substituted for hybrid charges such as hybrid charge 100 if the reactive material in the charge holders 500, 550, and 570 is sufficient for the deflagration and well stimulation. Thus, the combination of shaped charges and charge holders 500, 550, and 570 may form hybrid charges.

Figure 5A:
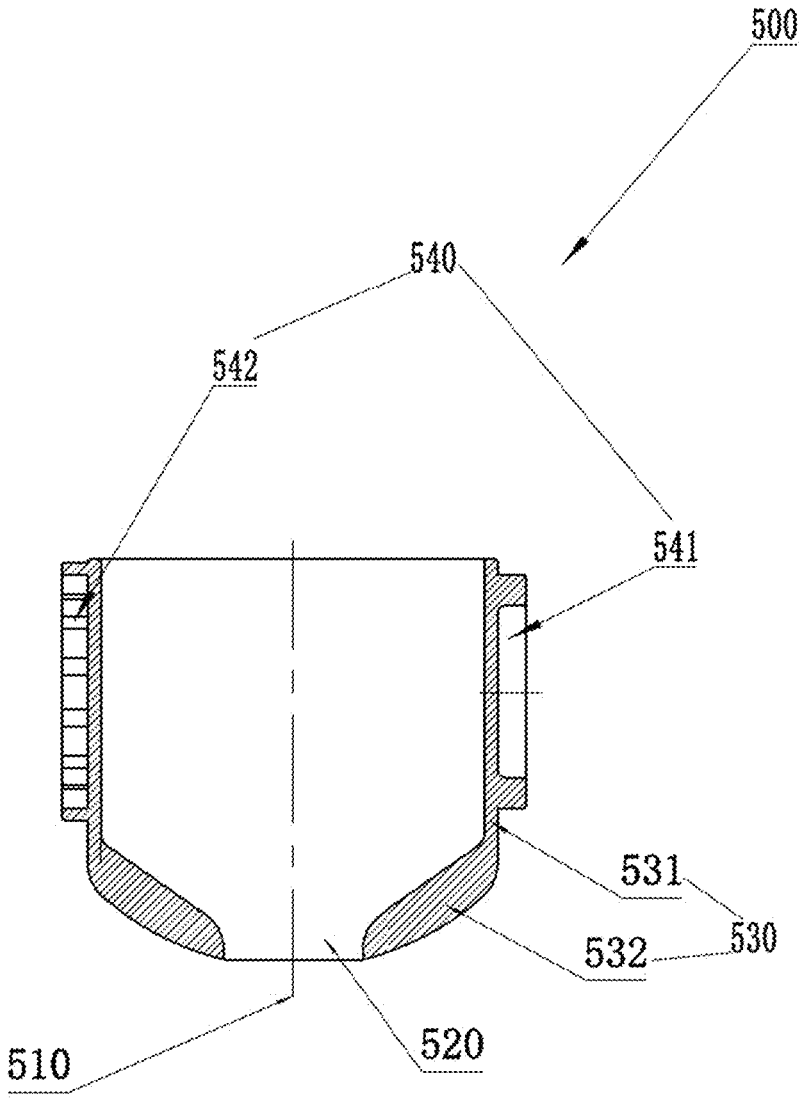
FIGS. 5A through 5F illustrate hybrid downhole stimulating tools according to different embodiments.

FIG. 5A shows an example of a charge holder 500. As discussed above, reference line 510 denotes a direction of a jet after detonation of a main explosive in a shaped charged cavity such as shaped charge cavity 140. The reference line 510 passes through a hole 520 in the charge holder 500. The charge holder 500 includes a housing (housing member) 530 and a rotating coupler 540. The rotating coupler 540 may include a male interface 541 and a female interface 542. The housing 530 may include a housing barrel 531 including reactive material and a housing hood 532. The housing barrel 531 may be placed on the outside of the hybrid charge or shaped charge to accommodate the hybrid charge or the shaped charge. The housing hood 532 of the charge holder 500 has the hole 520 for passage of the jet during detonation of the hybrid charge or the shaped charge.

Figure 5B:
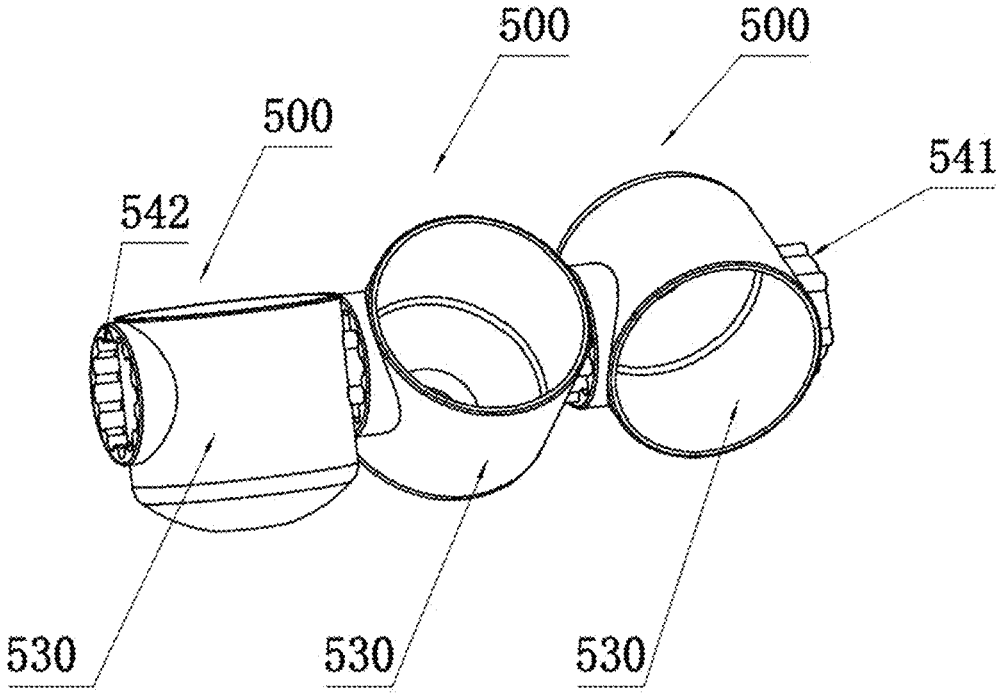

FIG. 5B shows an example of how a plurality of charge holders 500 in FIG. 5A are rotatably coupled to each other using the rotating coupler 540. As shown in FIG. 5B, a male interface 541 of one charge holder 500 is rotatably coupled to a female interface 542 of another charge holder 500. Accordingly, any number of charge couplers 500 may be rotatably coupled to each other to deliver hybrid charges such as hybrid charge 100 or shaped charges such as shaped charge 110 into a borehole for detonation and deflagration to stimulate a well. The charge holders 500 may be oriented at any angle and may be oriented according to a phase requirement of the hybrid charge such as charge 100 or the shaped charge such as shaped charge 110 using the rotating couplers 540. The male interface 541 and the female interface 542 of the rotating coupler 540 are symmetrical on each side of the housing 530. A male interface 541 may have a number of bumps uniformly provided outwardly in the circumference and the female interface 542 may have a number of grooves uniformly provided inwardly in the circumference to match the bumps. The rotation and positioning are achieved by cooperation of the bumps and the grooves.

Figure 5C:
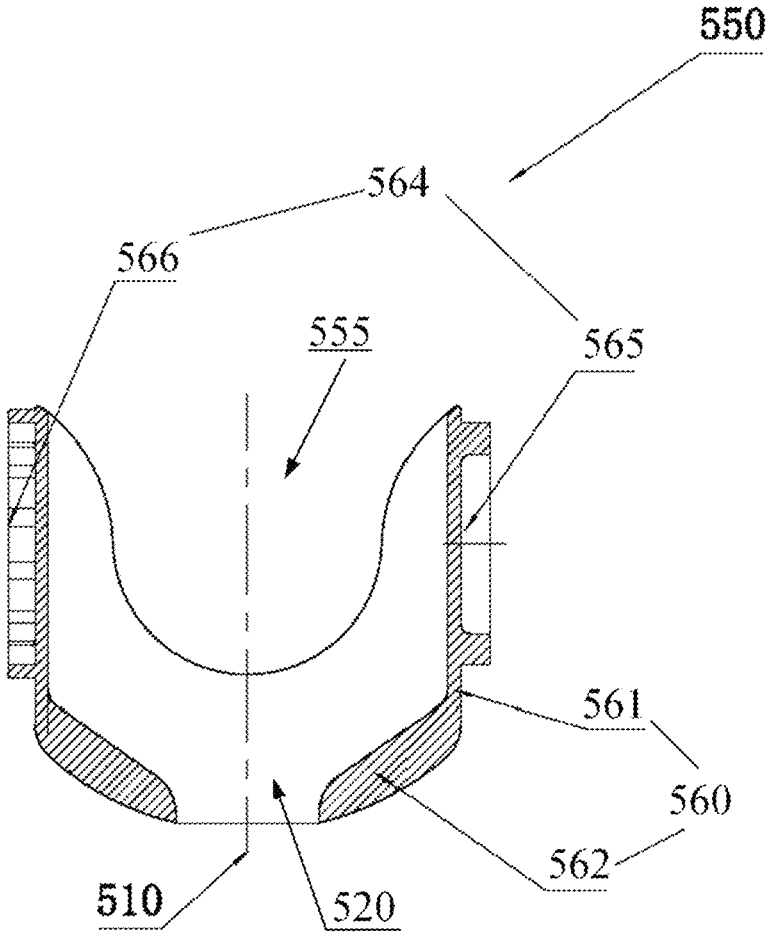
Figure 5D:
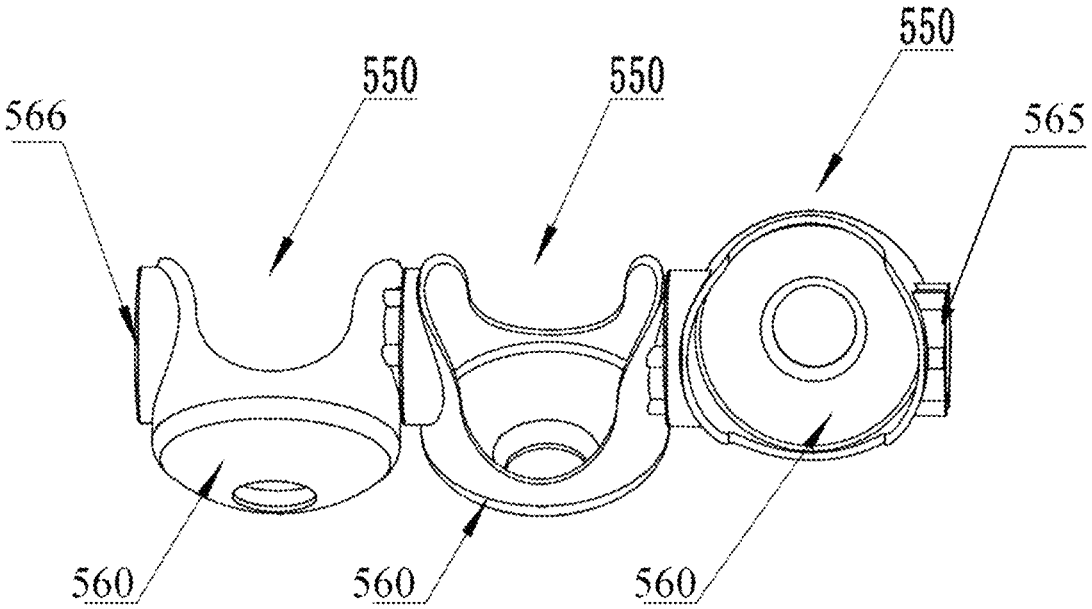

FIG. 5C shows an example of a charge holder 550, which is charge holder 500 in FIG. 5A with a slot 555 in the housing barrel 531 of the housing 530 of the charge holder 500, and FIG. 5D shows an example of how a plurality of charge holders 550 in FIG. 5C are rotatably coupled to each other. As discussed above, the reference line 510 passes through a hole 520 in the charge holder 550. The charge holder 550 includes a housing (housing member) 560 and a rotating coupler 564. The rotating coupler 564 may include a male interface 565 and a female interface 566. The housing 560 may include a housing barrel 561 including reactive material and a housing hood 562. The housing barrel 561 may be placed on the outside of the hybrid charge or shaped charge to accommodate the hybrid charge or the shaped charge. The housing hood 562 of the charge holder 550 has the hole 520 for passage of the jet during detonation of the hybrid charge or the shaped charge. One or more slots 555 may be in the housing barrel 561. The one or more slots 555 may be present to accommodate a shape and/or size of a hybrid charge or shaped charge. The one or more slots 555 may adjust the energy level of the secondary burst pressure and positioning of the hybrid charge or shaped charge.

FIG. 5D shows an example of how a plurality of charge holders 550 in FIG. 5C are rotatably coupled to each other using the rotating coupler 564. As shown in FIG. 5D, a male interface 565 of one charge holder 550 is rotatably coupled to a female interface 566 of another charge holder 550. Accordingly, any number of charge holders 550 may be rotatably coupled to each other by rotating couplers 564 to deliver hybrid charges such as hybrid charge 100 or shaped charges such as shaped charge 110 into a borehole for detonation and deflagration to stimulate a well. The charge holders 550 may be oriented at any angle and may be oriented according to a phase requirement of the hybrid charge such as charge 100 or the shaped charge such as shaped charge 110 using the rotating couplers 564. The male interface 565 and the female interface 566 of the rotating coupler 564 are symmetrical on each side of the housing 560. A male interface 565 may have a number of bumps uniformly provided outwardly in the circumference and the female interface 566 may have a number of grooves uniformly provided inwardly in the circumference to match the bumps. The rotation and positioning are achieved by cooperation of the bumps and the grooves. The rotating coupler 564 in FIGS. 5C and 5D may be the same as, similar to, or different from the rotating coupler 540 in FIGS. 5A and 5B.

Figure 5E:
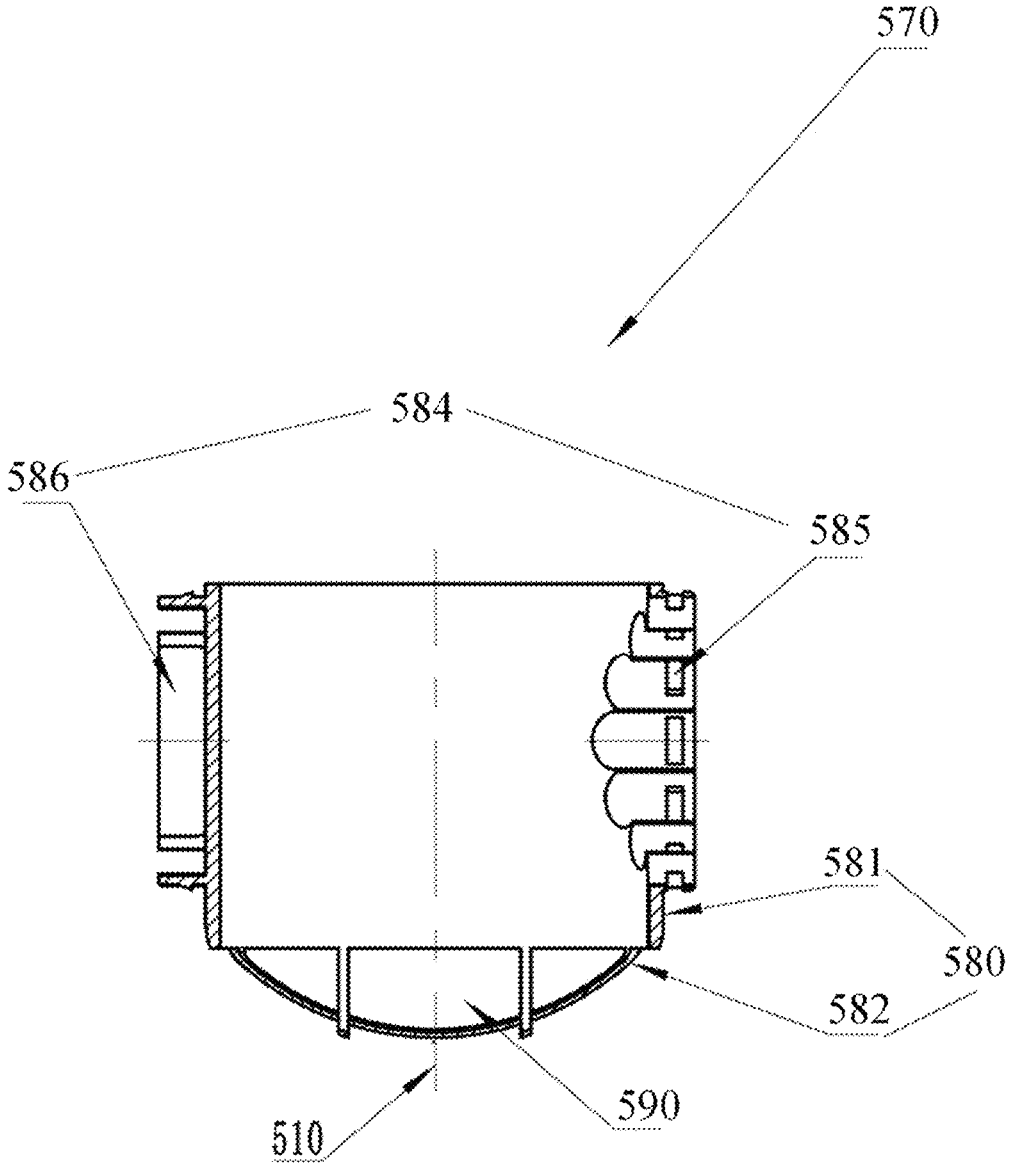
Figure 5F:
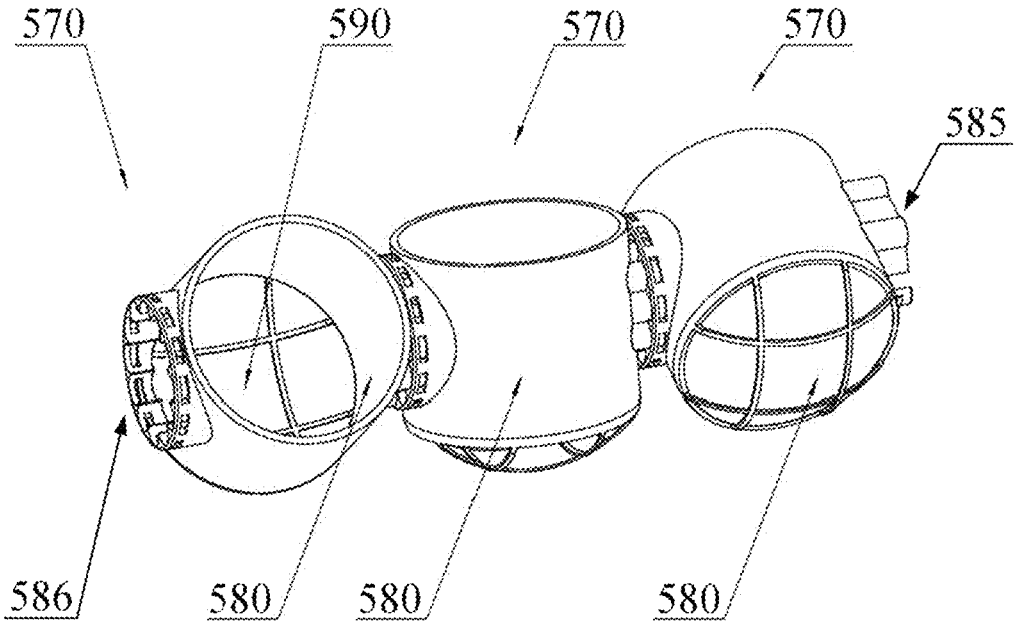

FIG. 5E shows an example of a charge holder 570, which is a charge holder 500 in FIG. 5A with a housing hood including a hollow structure, and FIG. 5F shows an example of a how a plurality of charge holders 570 are rotatably coupled to each other. As discussed above, reference line 510 denotes a direction of a jet after detonation of a main explosive in a shaped charged cavity such as shaped charge cavity 140. The charge holder 570 includes a housing (housing member) 580 and a rotating coupler 584. The rotating coupler 584 may include a male interface 585 and a female interface 586. The housing 580 may include a housing barrel 581 including reactive material and a housing hood 582. The housing barrel 581 may be placed on the outside of the hybrid charge or shaped charge to accommodate the hybrid charge or the shaped charge. In FIGS. 5E and 5F, the housing hood 582 of the charge holder 570 has a hollow structure including a space 590 for passage of the jet during detonation of the hybrid charge or the shaped charge. The housing hood 582 may adjust the energy level of secondary burst pressure and positioning of the hybrid charge or shaped charge according to the size of the hybrid charge or shaped charge.

Figure 6:
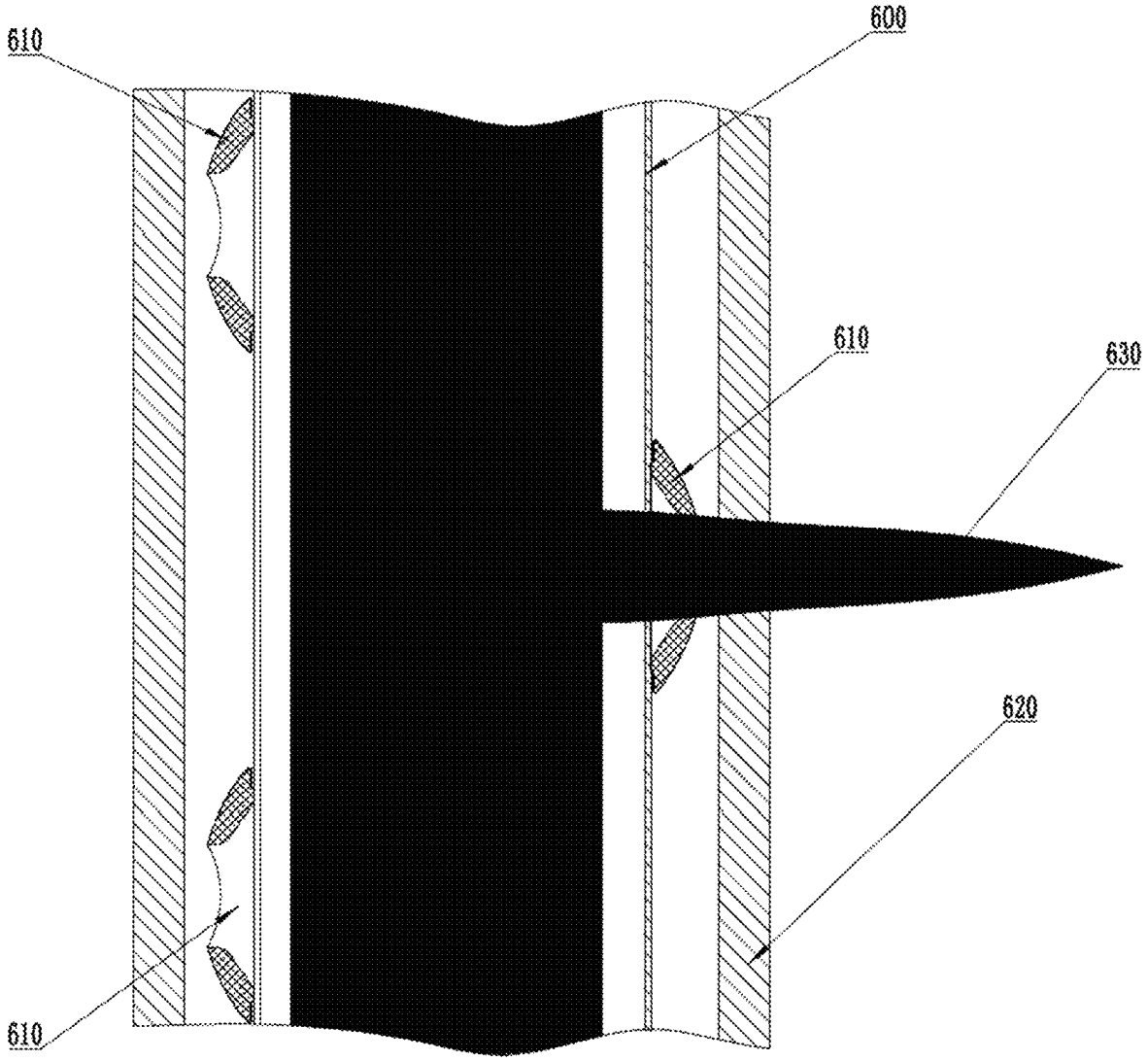
FIG. 6 is a view of a hybrid downhole stimulating tool according to an embodiment.

FIG. 5F shows an example of how a plurality of charge holders 570 in FIG. 5E are rotatably coupled to each other using a male interface 585 and a female interface 586 of a rotating coupler 584. As shown in FIG. 5E, a male interface 585 of one charge holder 570 is rotatably coupled to a female interface 586 of another charge holder 570. Accordingly, any number of charge couplers 584 may be rotatably coupled to each other to deliver hybrid charges such as hybrid charge 100 or shaped charges such as shaped charge 110 into a borehole for detonation and deflagration to stimulate a well. The charge holders 570 may be oriented at any angle and may be oriented according to a phase requirement of the hybrid charge such as charge 100 or the shaped charge such as shaped charge 110 using the rotating couplers 584. The male interface 585 and the female interface 586 of the rotating coupler 584 are symmetrical on each side of the housing 580. A male interface 585 may have a number of bumps uniformly provided outwardly in the circumference and the female interface 586 may have a number of grooves uniformly provided inwardly in the circumference to match the bumps. The rotation and positioning are achieved by cooperation of the bumps and the grooves. The rotating coupler 584 in FIGS. 5E and 5F may be the same as, similar to, or different from the rotating coupler 540 in FIGS. 5A and 5B FIG. 6 is a view of a hybrid downhole stimulating tool (downhole stimulating assembly) according to an embodiment. FIG. 6 shows a tube 600 configured to attach one or more reactive material members 610, which is lowered into a borehole having a well casing 620. The attachment of one or more reactive members 610 may include mounting, connecting, or coupling the one or more reactive members to the tube 600. The tube may be fixed with a laser cutting tool or plasma cutting tool. The size of the diameter of tube 600 may be smaller than the size of the diameter of well casing 620. Well casing 620 separates the borehole from the formation (well formation). The one or more reactive material members 610 may be the same shape and size or different shapes and sizes. FIG. 6 shows a laser beam or a plasma beam striking a reactive material member 610 and perforating well casing 620 and tunneling into the formation, which is denoted by reference numeral 630. The laser beam or plasma beam creates perforation tunnels in the well formation. The laser beam or plasma beam may be generated in response to one or more triggering instructions (e.g., one or more electrical detonation signals) from a control system from the surface above a borehole of a well.

The power and heat from the laser beam or plasma beam the reactive material member 610 into reactive material particles, which excites the reactive material particles. The reactive material member 610 may have the same or similar structure and properties as reactive material member 150. The reactive material particles will be forced to follow the direction of the laser beam or plasm beam going into the perforated tunnels. The reactive material particles are fully excited by the laser beam or plasma beam, and produce a sustained deflagration reaction in the perforated tunnels in the perforated formation (perforated well formation). The sustained deflagration stimulates the well so that oil and gas enter the well for removal from the well While embodiments of this disclosure have been shown and described, modifications can be made by one skilled in the art without departing from the spirit or teaching of this invention. The embodiments described herein are exemplary only and are not limiting. Many variations and modifications of methods, systems and apparatuses are possible and are within the scope of the invention. Accordingly, the scope of protection is not limited to the embodiments described herein, but is only limited by the claims. The scope of the claims shall include all equivalents of the subject matter of the claims.

What is claimed is:

1. A hybrid charge for perforating and stimulating a well, comprising:

a shaped charge including a shaped charge case, a shaped charge liner disposed inside the shaped charge case, a shaped charge cavity formed between the shaped charge case and the shaped charge liner to receive a main explosive, and a detonating hole including a primer charge and configured to communicate with the shaped charge cavity for detonation of the main explosive; and a reactive material member affixed to a frontal face of the shaped charge and spaced away from the shaped charge liner, wherein the reactive material comprises at least one metal and at least one oxygen-free oxidizer.

2. The hybrid charge of claim 1, wherein the reactive material member has a shape of a cap, a ring, two half rings, or multiple sections of a ring shape.

3. The hybrid charge of claim 1, wherein, during operation, the shaped charge detonates and creates a jet that penetrates the formation to form a perforation tunnel, and the reactive material enters the perforation tunnel and releases energy to further break the formation surrounding the perforation tunnel.

4. The hybrid charge of claim 1, wherein the least one metal is selected from the group consisting of aluminum, magnesium, molybdenum, nickel, zinc, and titanium, and at least one oxygen-free oxidizer is one or more fluoropolymers.

5. The hybrid charge of claim 1, wherein the reactive material member has a strength in a range of 1-20 megapascal pressure.

6. The hybrid charge of claim 1, wherein the reactive material member has a mass in a range of 3 to 100 grams.

7. A hybrid downhole stimulation tool for perforating a well formation to stimulate a well, comprising:

a barrel having a tubular shape configured to be lowered into a borehole of the well having a well casing separating the borehole from the well formation;

one or more hybrid charges of claim 1 loaded into the barrel;

a detonating cord, coupled to the one or more hybrid charges; and a detonator configured to receive a triggering instruction from a firing control system, and configured to ignite the detonation cord to detonate the one or more hybrid charges.

8. A hybrid downhole stimulation tool for perforating and stimulating a well formation, comprising:

a hybrid charge loading strip including a plurality of fastening members connected together, a plurality of explosive charges, each explosive charge affixed to one of the plurality of fastening members, wherein each explosive charge is the hybrid charge or the shaped charge of claim 1;

a detonating cord, coupled to the plurality of fastening members; and a detonator configured to receive a triggering instruction from a firing control system, and configured to ignite the detonation cord to ignite the plurality of explosive charges.

9. The hybrid downhole simulation tool of claim 8, wherein each fastening member is made of or contains the reactive material.

10. A method for stimulating a well, comprising:

lowering one or more hybrid charges of claim 1 oriented in one or more directions into a well including a well formation, and igniting the one or more hybrid charges to generate one or more jets to perforate the well formation to form one or more perforation tunnels in the well formation.

11. The method of claim 10, wherein the reactive material member comprises:

at least one metal selected from the group consisting of aluminum, magnesium, molybdenum, nickel, zinc, and titanium; and at least one oxygen-free oxidizer, selected from one or more fluoropolymers.

12. The method of claim 10, wherein each reactive material member has a strength in a range of 1-20 megapascal pressure.

* * * * *